US011535411B2

(12) United States Patent
Mellin et al.

(10) Patent No.: US 11,535,411 B2
(45) Date of Patent: Dec. 27, 2022

(54) FOLDING APPARATUS

(71) Applicant: The Procter & Gamble Company, Cincinnati, OH (US)

(72) Inventors: Gustav André Mellin, Amberly Village, OH (US); Pawel Marek Siczek, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 195 days.

(21) Appl. No.: 16/720,029

(22) Filed: Dec. 19, 2019

(65) Prior Publication Data

US 2021/0188468 A1 Jun. 24, 2021

(51) Int. Cl.

| | |
|---|---|
| ***B65B 11/32*** | (2006.01) |
| ***B65B 25/14*** | (2006.01) |
| ***B65B 11/48*** | (2006.01) |

(52) U.S. Cl.

CPC ..... *B65B 11/32* (2013.01); *B65B 11/48* (2013.01); *B65B 25/146* (2013.01)

(58) Field of Classification Search

CPC ..... B65B 11/10; B65B 11/12; B65B 11/32; B65B 11/48; B65B 25/146; B65B 49/04; B65B 7/20; B65B 7/22; B31B 50/36; B31B 50/42; B31B 50/626

USPC ..... 53/545, 482

See application file for complete search history.

(56) References Cited

U.S. PATENT DOCUMENTS

| | | | |
|---|---|---|---|
| 466,120 | A | 12/1891 | McCombs |
| 671,761 | A | 4/1901 | Forbes |
| 708,459 | A | 9/1902 | Bryant |
| 832,766 | A | 10/1906 | Anitua |
| 874,620 | A | 12/1907 | Patterson |
| 967,624 | A | 8/1910 | Felmlee |
| 1,062,410 | A | 5/1913 | Merrell |
| 1,175,361 | A | 3/1916 | Kempf |
| 1,253,636 | A | 1/1918 | Sevigne |
| 1,544,126 | A | 6/1925 | Bellido |
| 1,554,369 | A | 9/1925 | Remington |
| 1,734,362 | A | 11/1929 | Brownell |
| 1,764,081 | A | 6/1930 | Jones |
| 1,839,567 | A | 1/1932 | Littlefield |
| 1,899,468 | A | 2/1933 | Littlefield |
| 1,946,697 | A | 2/1934 | Johnson |

(Continued)

FOREIGN PATENT DOCUMENTS

| | | | |
|---|---|---|---|
| CA | 1198664 | A | 12/1985 |
| CN | 206679352 | U | 11/2017 |

(Continued)

*Primary Examiner* — Anna K Kinsaul

*Assistant Examiner* — Luis G Del Valle

(74) *Attorney, Agent, or Firm* — Richard L. Alexander; Charles R. Matson

(57) ABSTRACT

A folding apparatus is provided to be positioned adjacent a conveyor along which product having a flexible film wrapper wrapped about the product moves adjacent the folding apparatus such that the folding apparatus effects the folding of a first flap of the wrapper. The folding apparatus comprises a passive folding device comprising a first passive folding member defining a first passive folding surface adapted to engage the first flap as the product and the film wrapper move in a machine direction and folding the first flap from a first position away from the product to a second position adjacent the product.

19 Claims, 8 Drawing Sheets

(56) References Cited

U.S. PATENT DOCUMENTS

| | | | | | |
|---|---|---|---|---|---|
| 1,984,812 | A | | 12/1934 | Schmitt | |
| 2,050,717 | A | | 8/1936 | Malocsay | |
| 2,106,999 | A | | 2/1938 | Goerke | |
| 2,110,113 | A | | 3/1938 | Sandberg | |
| 2,144,448 | A | | 1/1939 | Brightwell | |
| 2,215,545 | A | | 9/1940 | Demler | |
| 2,220,367 | A | | 11/1940 | Gellman | |
| 2,235,503 | A | | 3/1941 | Petakeyes | |
| 2,246,268 | A | | 6/1941 | Smith | |
| 2,391,316 | A | | 12/1945 | Thormod | |
| 2,443,952 | A | | 6/1948 | Gilbert | |
| 2,458,971 | A | | 1/1949 | Wilson | |
| 2,624,166 | A | | 1/1953 | Valiquet | |
| 2,676,445 | A | | 4/1954 | Kottmann | |
| 2,704,592 | A | | 3/1955 | Hoppe | |
| 2,722,094 | A | | 11/1955 | Forster | |
| 2,783,600 | A | | 3/1957 | Olson | |
| 2,817,933 | A | | 12/1957 | Bell | |
| 2,846,834 | A | | 8/1958 | Spriggs | |
| 2,860,466 | A | | 11/1958 | Ingram | |
| 2,874,527 | A | | 2/1959 | Cravits | |
| 2,906,069 | A | | 9/1959 | Page | |
| 3,069,826 | A | | 12/1962 | Littlefield | |
| 3,097,464 | A | | 7/1963 | Reeves | |
| 3,213,591 | A | | 10/1965 | Feurstein | |
| 3,220,155 | A | * | 11/1965 | Sherman | B65B 21/24 53/48.9 |
| 3,372,526 | A | | 3/1968 | Anderson | |
| 3,383,825 | A | | 5/1968 | Titchenal | |
| 3,462,915 | A | | 8/1969 | Anderson | |
| 3,619,970 | A | | 11/1971 | Zelnick | |
| 3,810,314 | A | | 5/1974 | Anderson | |
| 3,855,758 | A | | 12/1974 | Walter | |
| 4,035,985 | A | | 7/1977 | Aoyama | |
| 4,509,310 | A | | 4/1985 | Focke | |
| 4,574,564 | A | | 3/1986 | Pester | |
| 4,653,248 | A | | 3/1987 | Bergner | |
| 4,741,728 | A | * | 5/1988 | Bakx | B31B 50/00 493/131 |
| 5,078,057 | A | * | 1/1992 | Pearson | B65B 27/086 100/29 |
| 5,179,817 | A | | 1/1993 | Barnes | |
| 5,228,273 | A | | 7/1993 | Kovacs | |
| 5,406,774 | A | | 4/1995 | Dodge | |
| 5,465,554 | A | | 11/1995 | Lewis | |
| 5,486,152 | A | * | 1/1996 | Heinz | B65B 7/20 493/438 |
| 5,807,228 | A | * | 9/1998 | Smithe | B65H 45/22 493/438 |
| 5,819,506 | A | | 10/1998 | Frabetti | |
| 6,042,530 | A | * | 3/2000 | Bohn | B65H 45/12 493/440 |
| 6,067,780 | A | * | 5/2000 | Gentili | B65B 25/146 53/376.2 |
| 6,854,243 | B2 | | 2/2005 | Sendo | |
| 2004/0016213 | A1 | * | 1/2004 | Loperfido | B65B 25/146 53/461 |
| 2009/0120045 | A1 | * | 5/2009 | Gorrieri | B65B 59/001 53/543 |
| 2009/0139185 | A1 | * | 6/2009 | Gorrieri | B65B 25/146 53/251 |
| 2014/0224863 | A1 | * | 8/2014 | Revelly | B65D 75/5827 229/87.05 |
| 2014/0366695 | A1 | | 12/2014 | Kien | |
| 2014/0366702 | A1 | | 12/2014 | Kien | |
| 2014/0370224 | A1 | | 12/2014 | Kien | |
| 2015/0329226 | A1 | | 11/2015 | Testoni | |
| 2016/0271820 | A1 | | 9/2016 | Slovut | |
| 2016/0271823 | A1 | | 9/2016 | Slovut | |
| 2016/0271824 | A1 | | 9/2016 | Slovut | |

FOREIGN PATENT DOCUMENTS

| | | | |
|---|---|---|---|
| GB | 389152 | A | 3/1933 |
| GB | 436487 | A | 10/1935 |
| GB | 445884 | A | 4/1936 |
| GB | 525740 | A | 9/1940 |
| GB | 527900 | A | 10/1940 |
| GB | 602181 | A | 5/1948 |
| GB | 680115 | A | 10/1952 |
| GB | 706914 | A | 4/1954 |
| GB | 842899 | A | 7/1960 |
| GB | 1053078 | | 12/1966 |
| GB | 1326127 | A | 8/1973 |
| JP | 2005075365 | A | 3/2005 |
| JP | 2016117496 | A | 6/2016 |

* cited by examiner

| Pos Relative to $L_{FS}$ | 0% | 10% | 20% | 30% | 40% | 50% | 60% | 70% | 80% | 90% | $L_{FS}$ |
|---|---|---|---|---|---|---|---|---|---|---|---|
| Deg. Surface (θ) | 0° | 10° | 20° | 30° | 40° | 48° | 57° | 67° | 76° | 85° | 90° |

FOLDING APPARATUS

FIELD OF THE INVENTION

The present invention generally relates to an apparatus for folding one or more flaps of a flexible film wrapper positioned about a consumer product comprising one or more rolls of paper, such as one or more paper towel rolls or toilet tissue rolls.

BACKGROUND OF THE INVENTION

A consumer product, such as one or more paper towel or toilet tissue rolls, is typically wrapped in a flexible film wrapper prior to sale. The film wrapper is formed during manufacturing by wrapping a flexible film about the product and together, as the film wrapper and product move down a conveyor, folding one or more end flaps of the wrapper against the product using folding structure and then heat sealing the folded flaps to effect closure of the film wrapper. Traditional folding structure and folding methods have limitations, which can result in wrinkles in final folds, undesirable film stretching and reduction in production speed.

SUMMARY OF THE INVENTION

In accordance with a first aspect of the present invention, a folding apparatus is adapted to be positioned adjacent a conveyor along which product having a flexible film wrapper wrapped about the product moves in a machine direction adjacent the folding apparatus such that the folding apparatus effects the folding of a first flap of the wrapper. The first flap having a first width extending from the product to an outermost edge of the first flap. The first width extends transverse to the machine direction. The folding apparatus may comprise a passive folding device comprising a first passive folding member defining a first passive folding surface adapted to engage the first flap as the product and the film wrapper move in the machine direction and folding the first flap from a first position away from the product to a second position adjacent the product. The first passive folding surface may comprise an entry section and an exit section and may have a second width that increases from the entry section to an intermediate point between the entry section and the exit section to a size sufficient to support a substantial portion of the first flap as the first flap moves from the intermediate point toward the second position.

The entry section of the first passive folding surface may be positioned in a first plane and the exit section of the first passive folding surface may be positioned in a second plane generally transverse to the first plane. The first plane may comprise a generally horizontal first plane and the second plane may comprise a generally vertical second plane.

An angle of the first passive folding surface relative to a horizontal plane may vary from the entry section to the exit section. The angle of the first passive folding surface relative to a horizontal plane may change from the entry section to an intermediate point along the first passive folding surface at a rate that is greater than the rate at which the angle of the first passive folding surface relative to a horizontal plane changes from the intermediate point to the exit section.

The second width of the first passive folding surface may increase in size as the first passive folding surface extends from the entry section to a location near the exit section.

The first passive folding surface may be defined by first and second spaced apart edges, at least one of the first and second edges may be shaped substantially as an exponential curve. In a particular example, the first edge may be substantially linear and the second edge may be defined by the one edge of the first passive folding surface shaped substantially as an exponential curve. The passive folding device may further comprise a second passive folding member defining a second passive folding surface. The first and second passive folding members may be positioned relative to one another such that the first and second passive folding surfaces are spaced apart and opposed to one another to define a slot into and through which the first flap moves as it is folded from the first position away from the product to the second position adjacent the product.

The first and second passive folding members may be formed from a substantially transparent polymeric material.

The passive folding device may further comprise a passive folding element for engaging and folding a second flap from a first position away from the product to a second position adjacent the product.

In accordance with a second aspect of the present invention, a folding apparatus is adapted to be positioned adjacent a conveyor along which product having a flexible film wrapper wrapped about the product moves in a machine direction adjacent the folding apparatus such that the folding apparatus effects the folding of a first flap of the wrapper. The first flap has a first width extending from the product to an outermost edge of the first flap. The first width extends transverse to the machine direction. The folding apparatus may comprise: a passive folding device comprising a first passive folding member defining a first passive folding surface adapted to engage the first flap as the product and the film wrapper move in the machine direction and folding the first flap of the film wrapper from a first position away from the product to a second position adjacent the product. The first passive folding surface may comprise an entry section which is positioned in a first plane and an exit section which is positioned in a second plane generally transverse to the first plane.

The first passive folding surface may transition through 90 degrees from the entry section to the exit section.

In accordance with a third aspect of the present invention, a folding apparatus is adapted to be positioned adjacent a conveyor along which product having a flexible film wrapper wrapped about the product moves in a machine direction adjacent the folding apparatus such that the folding apparatus effects the folding of first and second flaps of the wrapper. The folding apparatus may comprise: a passive folding device comprising: a first passive folding member defining a first passive folding surface, a second passive folding member defining a second passive folding surface and a passive folding element coupled to one of the first passive folding member or the second passive folding member. The first and second passive folding members may be positioned relative to one another such that the first and second passive folding surfaces are spaced apart and opposed to one another to define a slot into and through which the first flap moves as the product and film wrapper move in the machine direction to effect the folding of the first flap of the film wrapper from a first position away from the product to a second position adjacent the product. The passive folding element may engage and fold the second flap of the wrapper from a first position away from the product to a second position adjacent the product.

DETAILED DESCRIPTION OF THE INVENTION

Figure 1A:
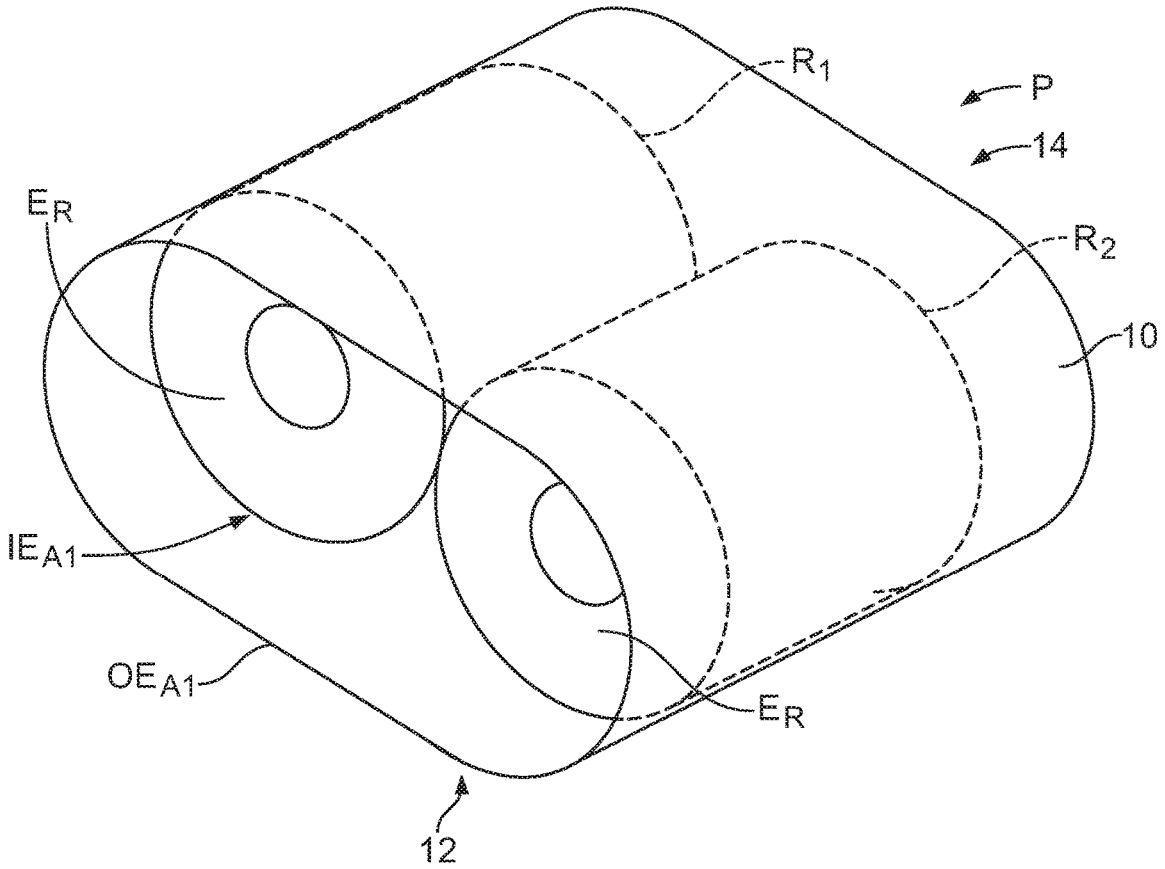
FIG. 1A illustrates a consumer product comprising first and second rolls of paper wrapped in a flexible film wrapper having first and second open ends.
Figure 1B:
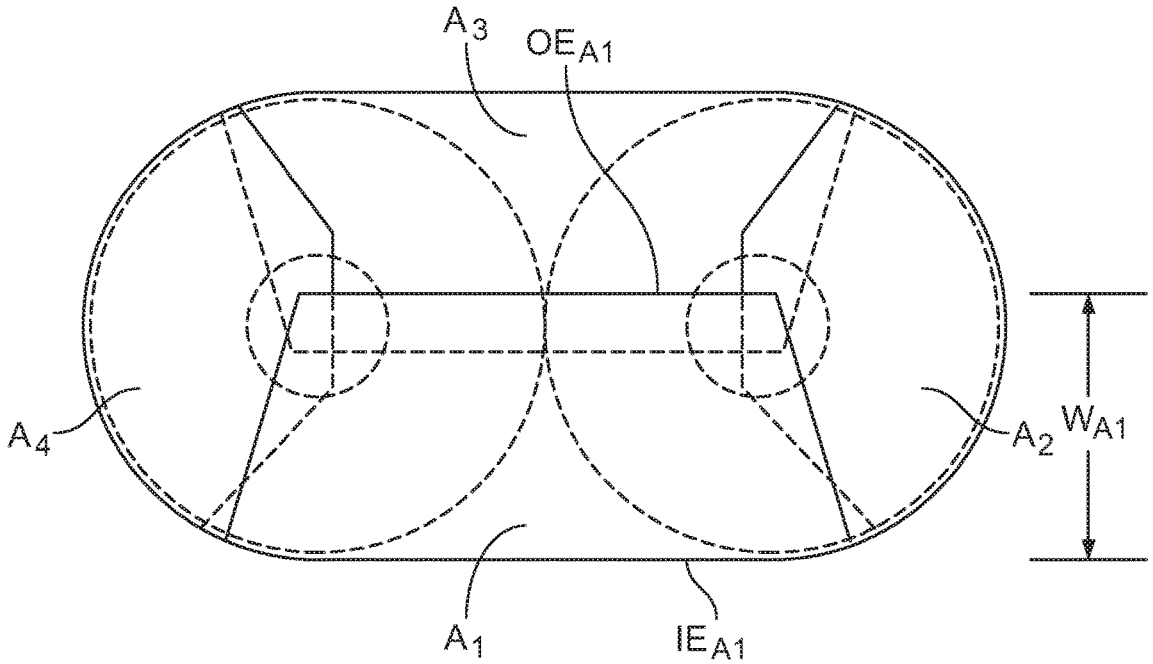
FIG. 1B is an end view of the product and film wrapper with first, second, third and fourth flaps of the film wrapper folded against the product.

Referring to FIG. 1A, a consumer product P comprising first and second rolls $R_1$ and $R_2$ of paper, which may comprise paper towel or toilet tissue rolls, is shown wrapped in a flexible film wrapper 10 having first and second ends 12 and 14, which are open and extend beyond the ends $E_R$ of the first and second rolls $R_1$ and $R_2$. The flexible film wrapper 10 may be formed from a heat-sealable polymeric material, such as polyethylene including a low density polyethylene. During production, the product P and the film wrapper 10 encased about the product P move in a machine direction MD along a conveyor belt B, see FIG. 2. First, second, third and fourth flaps A1-A4 at each of the first and second open ends 12 and 14 of the film wrapper 10, are folded from a first position away from the product P, see FIG. 1A, to a second position adjacent or against the product P, see FIG. 1B. The first flap A1 may comprise a bottom flap, the second flap A2 may comprise a forward end flap, the third flap A3 may comprise an upper flap and the fourth flap A4 may comprise a rear end flap, all of which may be shaped as illustrated in FIG. 1B. The flaps folded at the second end 14 may be shaped in a similar manner. After the flaps at the first and second ends 12 and 14 are folded against the product P, they are heat sealed together using conventional heat-sealing apparatus, e.g., heat sealing rolls or heat sealing jaws (not shown).

A description follows describing folding apparatus and a folding sequence for effecting the folds of the first, second, third and fourth flaps A1-A4 at the first end 12. While not explicitly described herein, similar folding apparatus and a folding sequence are provided for effecting the folds of the first, second, third and fourth flaps at the second end 14. It is also contemplated that the folding apparatus and folding sequence as described herein may be used with products having shapes other than that of a cylinder, such as napkins having a square or rectangular shape.

As the product P and film wrapper 10 encasing the product P are conveyed along the machine direction MD by the conveyor belt B, conventional folding structure, such as air jets directed toward the third flap A3 or a reciprocating mechanical folding mechanism (not shown), contacts the film wrapper 10 and folds the third flap A3 downwardly against the product P. This is the first of the first, second, third and fourth flaps A1-A4 folded against the product P. As will be discussed further below, a conventional rotating brush (not shown) contacts the film wrapper 10 and folds the fourth flap A4 so it is positioned against the product P.

Figure 2:
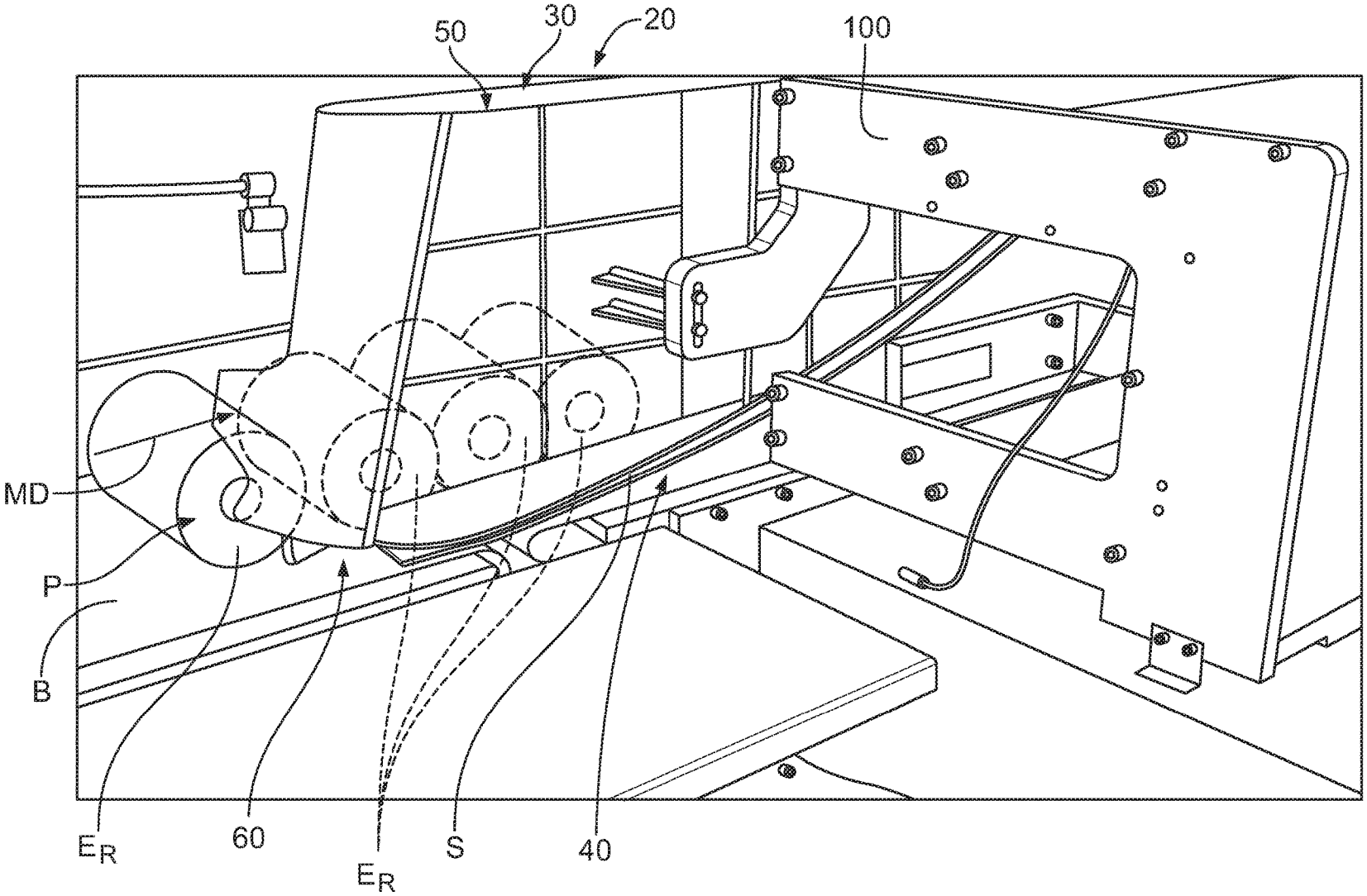
FIG. 2 is a perspective view of a folding apparatus of the present invention and product wrapped in a film wrapper moving on a conveyor belt relative to the folding apparatus.
Figure 5:
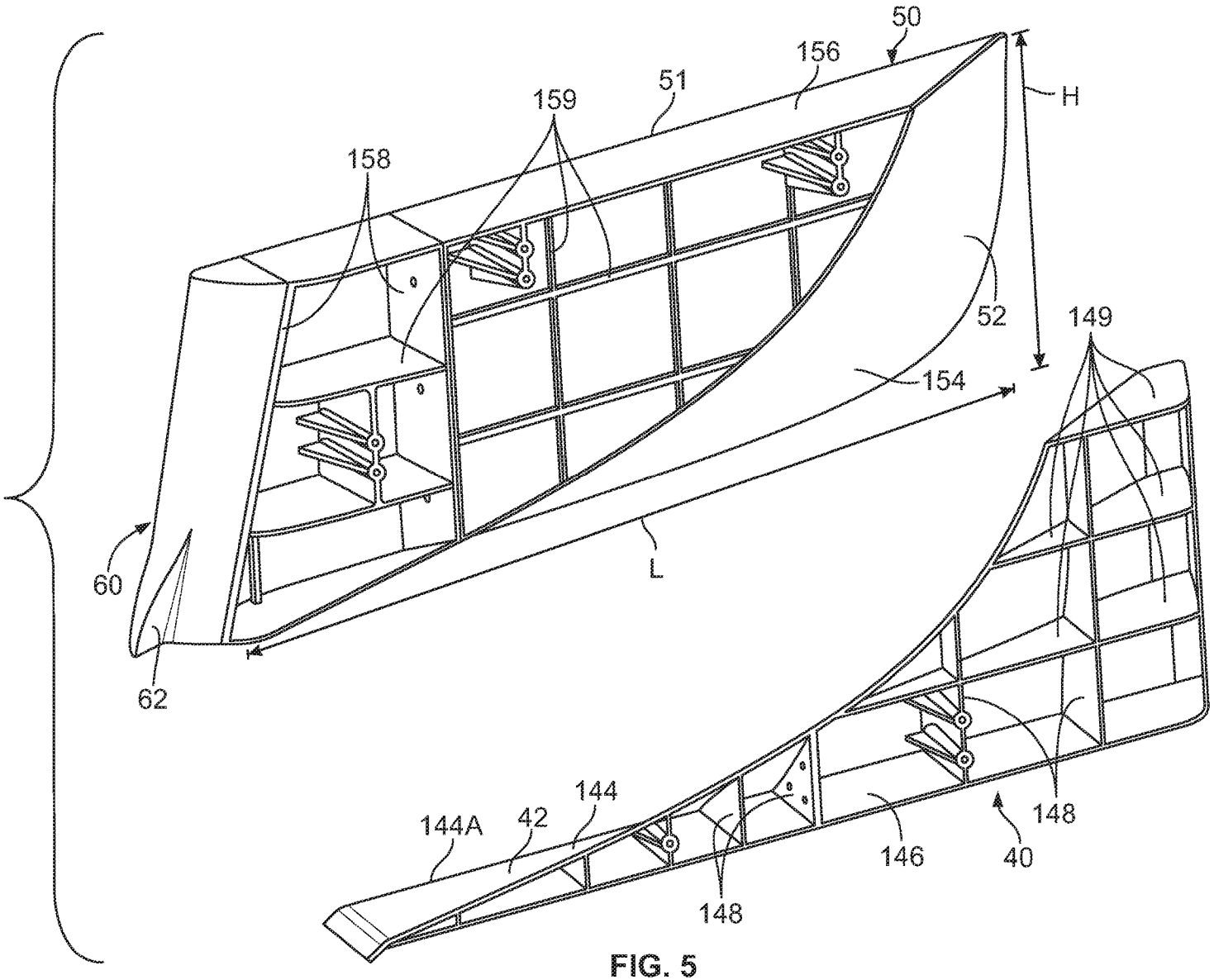
FIG. 5 is an exploded perspective view of the first and second passive folding members separated from one another.
Figure 6:
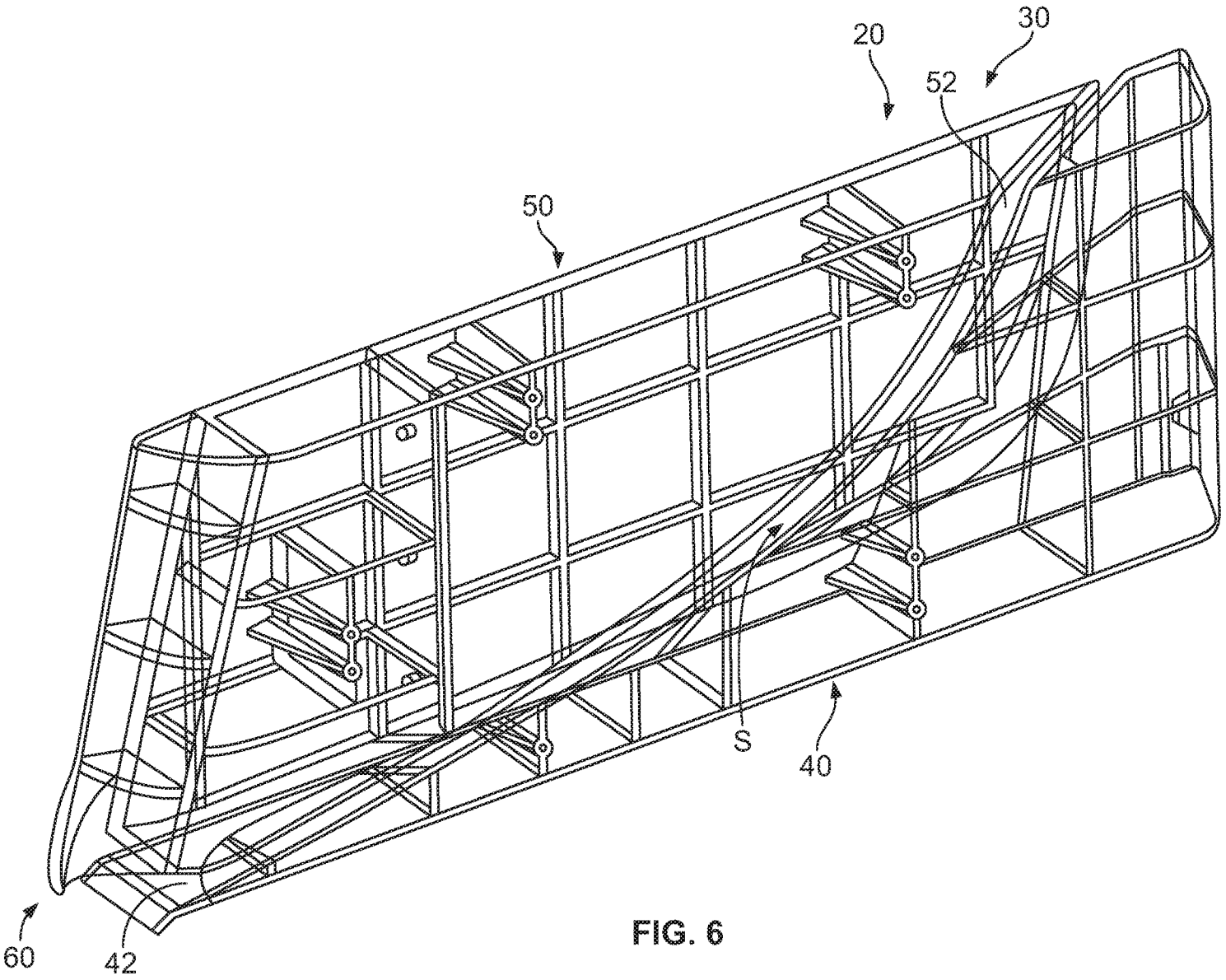
FIG. 6 is a view of the passive folding device with the first and second passive folding members shown as being transparent and positioned relative to one another to effect the folding of a first flap of a film wrapper.

In accordance with the present invention, a folding apparatus 20 is positioned adjacent to the conveyor belt B for effecting the folds of the first and second flaps A1 and A2, see FIGS. 2 and 6. The folding apparatus 20 comprises a passive folding device 30 comprising a first passive folding member 40 defining a first passive folding surface 42, see FIG. 4, a second passive folding member 50 defining a second passive folding surface 52, see FIG. 3, and a passive folding element 60 fixedly coupled to the second passive folding member 50. The first passive folding member 40 comprises an upper plate 144 having an outer surface defining the first passive folding surface 42, a bottom plate 146 defining a base of the first folding member 40, vertical plates 148 and support ribs 149, see FIG. 5. The second passive folding member 50 comprises a lower plate 154 having an outer surface defining the second passive folding surface 52, an upper plate 156, vertical plates 158 and support ribs 159, see FIG. 5. Mounting structure 100 is provided for mounting the first and second passive folding members 40 and 50 relative to one another and the conveyor belt B.

Figure 8:
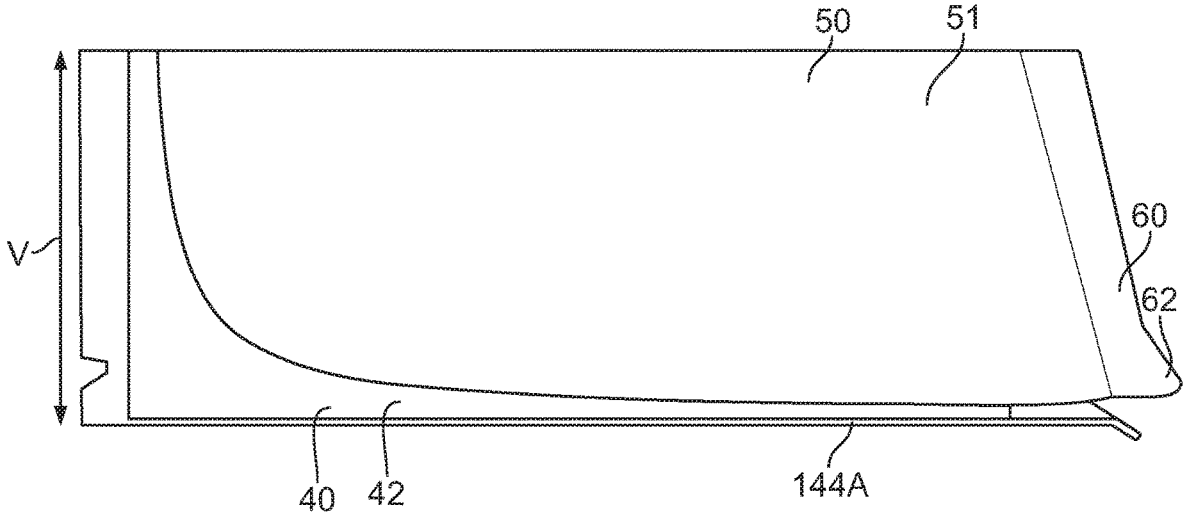
FIG. 8 is a side view of the passive folding device.

The second passive folding member 50 comprises a substantially planar outer wall 51, which may extend vertically, see FIG. 8. The outer wall 51 is positioned adjacent the conveyor belt B such that as the product P and film wrapper 10 encasing the product P are conveyed along the machine direction MD by the conveyor belt B, ends $E_R$ of the rolls are positioned adjacent to or engage the vertical outer wall 51 of the second folding member 50 such that the outer wall 51 positions and guides the rolls relative to the passive folding device 30. The first passive folding member 40 further comprises an outer, lower edge 144A, see FIG. 5. As the product P and film wrapper 10 encasing the product P are conveyed along the machine direction MD by the conveyor belt B, ends $E_R$ of the rolls are positioned adjacent to or engage the outer, lower edge 144A of the first passive folding member 40. In FIG. 2, the product P comprises four paper towel rolls wrapped in a flexible film wrapper 10 and are shown in engagement with the outer wall 51 of the second passive folding member 50 while on the conveyor belt B.

The first and second passive folding members 40 and 50 may be positioned relative to one another such that the first and second passive folding surfaces 42 and 52 are spaced apart and opposed to one another to define a receiving slot S. In one example, the slot S may have a dimension or gap extending between the first and second folding surfaces 42 and 52 of from about 5 mm to about 20 mm and in a preferred example may be 15 mm. The slot gap size may be constant along the entire length of the slot S. As the product P and film wrapper 10 move in the machine direction, with the ends $E_R$ of the rolls engaged with or moving adjacent to the outer wall 51 of the second folding member 50, the first flap A1 concurrently moves through the slot S and engages the first and second folding surfaces 42 and 52 of the first and second folding members 40 and 50 such that the folding surfaces 42 and 52 effect the folding of the first flap A1 of the film wrapper 10 from the first position, shown in FIG. 1A, away from the product P to the second position adjacent the product P, see FIG. 1B.

As illustrated in FIG. 1B, the first flap A1 has a first width $W_{A1}$ extending from an inner edge TEA' of the first flap A1 adjacent the product P to an outermost edge $OE_{A1}$ of the first flap A1. The first width $W_{A1}$ extends transverse to the machine direction MD. For standard paper towel rolls, the first width $W_{A1}$ of the first flap A1 may have a size of from 40 mm to about 240 mm.

Figure 4:
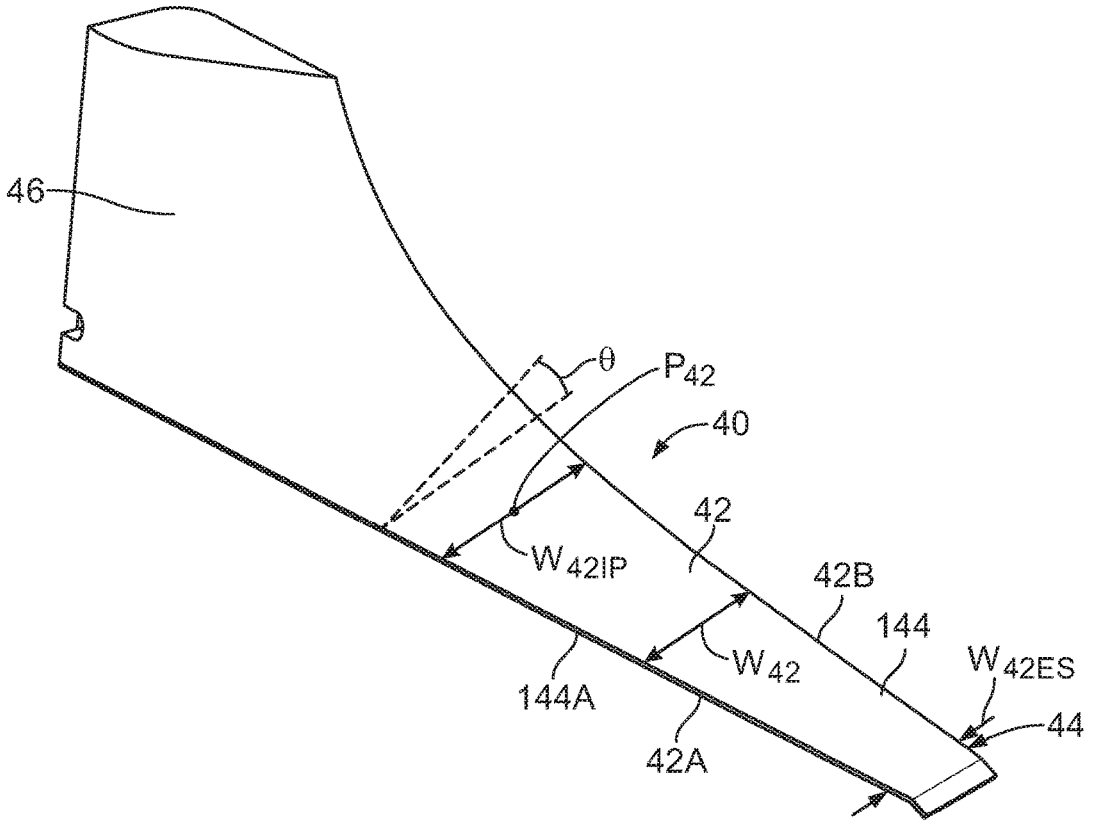
FIG. 4 is a perspective view of a first passive folding member of the passive folding device of the folding apparatus.
Figure 7:
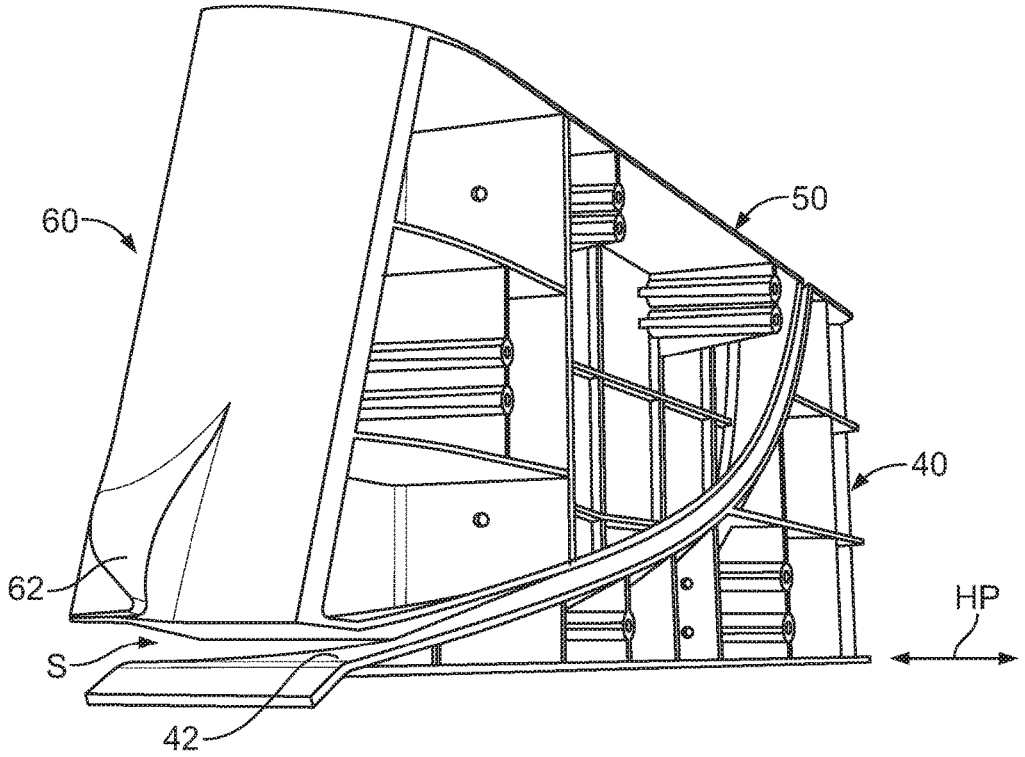
FIG. 7 is an end perspective view of the passive folding device.

As illustrated in FIG. 4, the first passive folding surface 42 of the first passive folding member 40 may comprise an entry section 44 positioned in a first plane, a first horizontal plane HP in the illustrated embodiment, see also FIG. 7, and an exit section 46 positioned in a second plane, a vertical plane V in the illustrated embodiment, see also FIG. 8, and is generally transverse to the first plane.

The first folding surface 42 engages the first flap A1 at the entry section 44 and moves the first flap A1 from the first position away from the product P, as illustrated in FIG. 1A, to the second position adjacent to or against the product P, as illustrated in FIG. 1B, wherein the second position is at or near the exit section 46. The first folding surface 42 may have a second width $W_{42}$ that increases from the entry section 44 to an intermediate point $P_{42}$ between the entry section 44 and the exit section 46 to a size sufficient to fully support a substantial portion of the first flap A1 as the first flap A1 moves from the intermediate point $P_{42}$ toward the second position, wherein a substantial portion of the first flap A1 comprises between 90% and 100% of the first width $W_{A1}$ of the first flap A1 and preferably comprises 100% of the first width $W_{A1}$ of the first flap A1. The second width $W_{42}$ of the first folding surface 42 near the entry section 44 is of a size sufficient to support at least 30% of the first width $W_{A1}$ of the first flap A1. The intermediate point $P_{42}$ between the entry section 44 and the exit section 46 may be located at a point at 40%, 50% or any point between 40% and 50% of the length $L_{FS}$ of the first folding surface 42 from the entry section 44, see FIGS. 4 and 9. Between the intermediate point $P_{42}$ and the exit section 46, the second width $W_{42}$ of the first passive surface 42 is of a sufficient size to fully support between 90% and 100% and preferably 100% of the first width $W_{A1}$ of the first flap A1. As can be seen from FIG. 4, the second width $W_{42}$ of the first folding surface 42 may increase in size as the first folding surface 42 extends from the entry section 44 to the exit section 46. Because the second width $W_{42}$ of the first folding surface 42 is sized at the entry section 42 to support at least 30% of the first width $W_{A1}$ of the first flap A1 and continues to increase in size such that between the intermediate point $P_{42}$ and the exit section 46 the first folding surface is sized to fully support a substantial portion of the first flap A1 as the first flap A1 moves towards the second position adjacent to or against the product P, as illustrated in FIG. 1B, the first flap A1 is adequately supported and controlled as it is gradually lifted and moved from its first position away from the product P to its second position adjacent the product. This advantageously results in fewer wrinkles being formed in the first flap A1 by the passive folding device 30, less undesirable film stretching and allows production speed to be increased. When used with standard paper towel rolls, the second width $W_{42ES}$ of the first folding surface 42 near the entry section 44 may have a size between 30 mm to 100 mm and the second width $W_{42IP}$ of the first folding surface 42 near the intermediate point $P_{42}$ may have a size between 90 mm to 250 mm, see FIG. 4.

Figure 9:
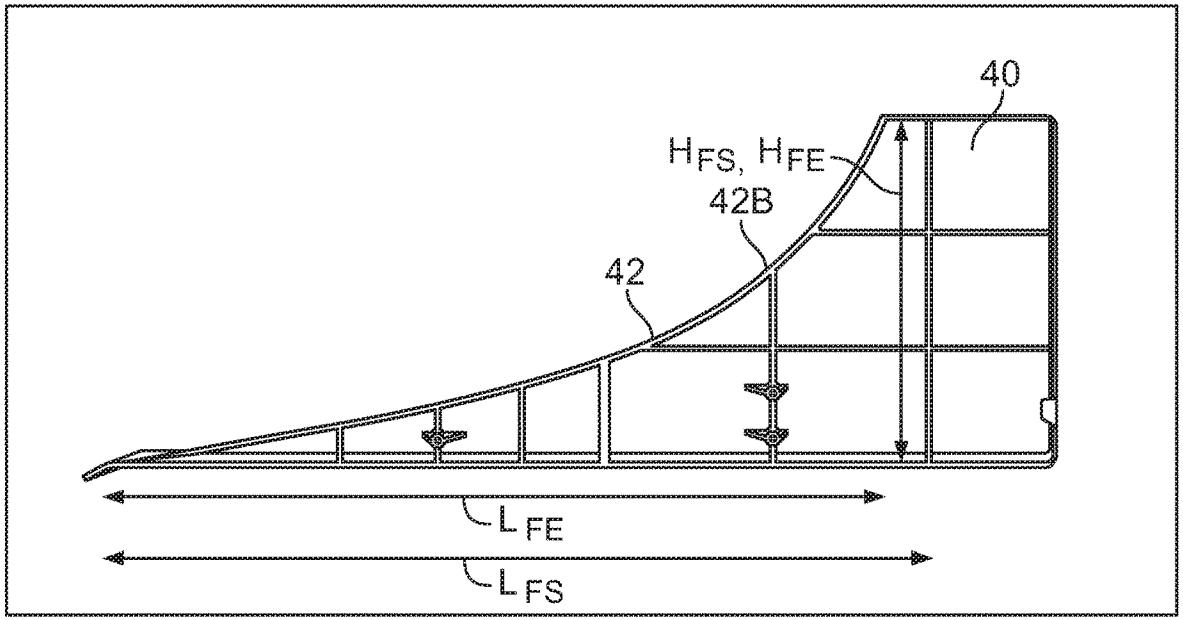
FIG. 9 is a side view of the first passive folding member with a table including values of an angle of a first folding surface of the first passive folding member relative to a horizontal plane at various locations along the length of the first folding surface.

An angle Θ of the first folding surface 42 relative to a horizontal plane HP, see FIGS. 4 and 7, may vary from the entry section 44 to the exit section 46, such that it transitions through 90 degrees from 0 degrees at the entry section 44 to 90 degrees at the exit section 46. The angle Θ of the first folding surface 42 relative to the horizontal plane HP may change from the entry section 44 to an intermediate point along the folding surface 42 at a rate that is greater than the rate at which the angle of the first folding surface 42 relative to the horizontal plane HP changes from the intermediate point to the exit section 46. In the embodiment illustrated in FIG. 9, the intermediate point could be a position or point at 50% of the length $L_{FS}$ of the first passive folding surface 42, see FIG. 9. In the example of FIG. 9, at an intermediate point defined as being located at 50% of the length $L_{FS}$ of the first passive folding surface 42, the angle θ of the first folding surface 42 changed from 0 degrees at the entry section 44 to 48 degrees at the intermediate point, and then changed from 48 degrees at the intermediate point to 90 degrees at the exit section 46. The change in angle Θ from the entry section 44 to the intermediate point was 48 degrees and the change in angle Θ from the intermediate point to the exit section 46 was 42 degrees.

In one example, the length $L_{FS}$ of the first folding surface 42 may comprise 4*the diameter of a roll of the product P and the height $H_{FS}$ of the first folding surface 42 may comprise 1.5 times the diameter of a roll of the product P, see FIG. 9. A typical paper towel roll may have a diameter of from 100 mm to 240 mm. Hence, in one example, the length $L_{FS}$ of the first folding surface 42 may be 960 mm and the height $H_{FS}$ of the first folding surface 42 may be 360 mm.

The first folding surface 42 may be defined by first and second spaced apart edges 42A and 42B, respectively, see FIG. 4. In the illustrated embodiment, the first edge 42A may be substantially linear and is generally parallel to the horizontal plane HP. The second edge 42B may have an exponential shape, or contour, and may be defined by equation 1, which is normalized for a first folding surface length $L_{FE}$ of 100% on the Y-axis, and is as follows:

$$y=a^{(x-b)*c}-d$$

where, x=the abscissa coordinate when the exponential shape is plotted using conventional cartesian coordinates, and y=the ordinate coordinate when the exponential shape is plotted using conventional cartesian coordinates.

Figure 10:
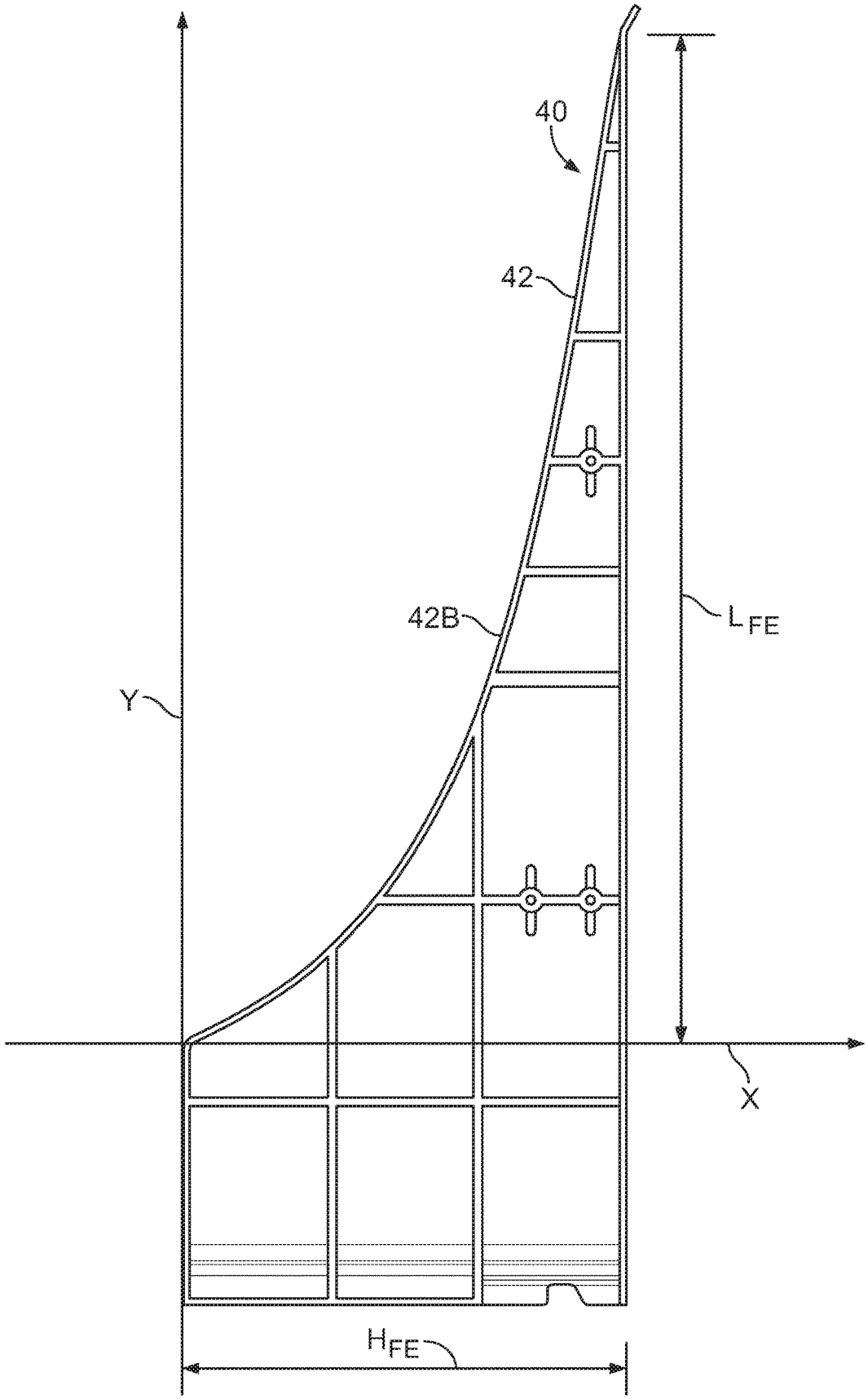
FIG. 10 illustrates a plot of a second edge of the first folding surface of the first passive folding member.

In one example, where:

a=8.0 b=−20 c=0.0390 d=5 the exponential shape of FIG. 10 is realized for the second edge 42B when x varies from values of 1 to 37 such that y varies from values of 0 to 96.8. Those values are then scaled such that the maximum Y value equals the desired length $L_{FE}$ of the first folding surface. Hence, for a desired first folding surface length $L_{FE}$=968 mm, the scaling factor=10. When the second edge 42B is oriented as shown in FIG. 9, it results in the second edge 42B having a length $L_{FE}$ that extends horizontally 968 mm and having a height $H_{FE}$ that extends vertically 370 mm.

Figure 3:
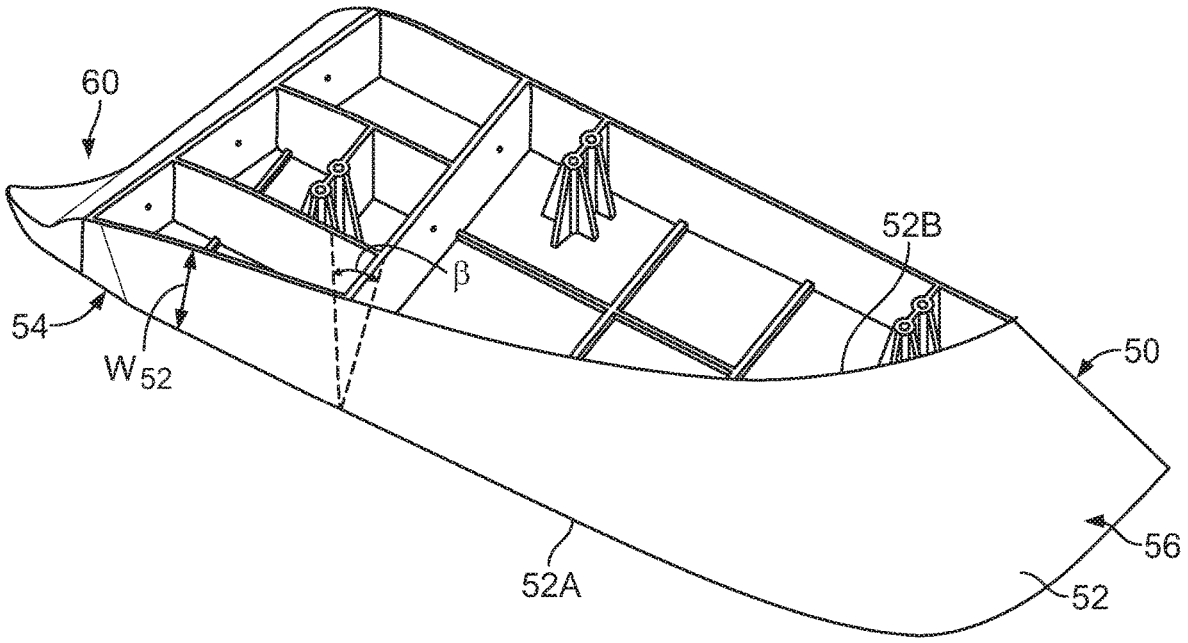
FIG. 3 is a perspective view of a second passive folding member of a passive folding device of the folding apparatus.

As illustrated in FIG. 3, the second passive folding surface 52 of the second passive folding member 50 may comprise an entry section 54 positioned in a second horizontal plane substantially parallel to the first horizontal plane HP, and an exit section 56 positioned in a vertical plane in the illustrated embodiment and is generally transverse to the second horizontal plane.

The second folding surface 52 may have a width $W_{52}$ near the entry section 54 of a size sufficient such that the second folding surface 52 extends over at least 30% of the first width $W_{A1}$ of the first flap A1. The width $W_{52}$ of the second folding surface 52 continues to increase in size from the entry section 54 such that between an intermediate point along the second folding surface 52 and the exit section 56, the width $W_{52}$ is of a size sufficient that the second folding surface 52 extends over a substantial portion of the first flap A1.

As can be seen from FIG. 3, the width $W_{52}$ of the second folding surface 52 increases in size as the second folding surface 52 extends from the entry section 54 to the exit section 56.

An angle β of the second folding surface 52 relative to a horizontal plane, see FIG. 3, may vary from the entry section 54 to the exit section 56, such that it transitions through 90 degrees from the entry section 54 to the exit section 56. The angle β of the second folding surface 52 relative to a horizontal plane may change from the entry section 54 to an intermediate point along the folding surface 52 at a rate that is greater than the rate at which the angle β of the folding surface 52 relative to the horizontal plane changes from the intermediate point to the exit section 56.

The second folding surface 52 may be defined by first and second spaced apart edges 52A and 52B, respectively, see FIG. 3. In the illustrated embodiment, the first edge 52A may initially be substantially linear and horizontal and then quickly turns and becomes vertical, see FIG. 3.

The second edge 52B may have an exponential shape and may also be defined by equation 1, set out above.

The second folding surface 52 may have a length L and height H equal to the length $L_{FS}$ and height $H_{FS}$ of the first folding surface 42, see FIG. 5.

The first and second passive folding members 40 and 50 may be formed from a substantially transparent polymeric material, one of which is sold under the tradename Accura 60 [SLA] by 3D Systems.

The passive folding element 60 is positioned before the second passive folding member 50 such that the product P and film wrapper 10 pass the passive folding element 60 as they move along the machine direction MD before passing the first and second passive folding members 40 and 50. The passive folding element 60 comprises a passive plow 62 that engages the second flap A2 at approximately a center location on the second flap A2 causing the second flap A2 to move from its initial, first position extending substantially parallel to longitudinal axes of the rolls $R_1$ and $R_2$ to a second position where the second flap A2 is positioned adjacent to or against the product P, see FIG. 1B.

As noted above, as the product P and film wrapper 10 encasing the product P are conveyed along the machine direction MD by the conveyor belt B and before reaching the folding apparatus 20, conventional folding structure contacts the film wrapper 10 and folds the third flap A3 downwardly against the product P. As the product P and film wrapper 10 continue to move with the conveyor belt B, the passive plow 62 engages the second flap A2 causing the second flap A2 to move from its first position away from the product P to the second position where the second flap A2 is positioned adjacent to or against the product P, see FIG. 1B. Further movement of the product and film wrapper 10 causes the first flap A1 to enter the slot S of the passive folding device 30, where the first flap A1 engages the first and second folding surfaces 42 and 52 of the first and second folding members 40 and 50 such that the folding surfaces 42 and 52 effect the folding of the first flap A1 of the film wrapper 10 from the first position, shown in FIG. 1A, away from the product P to the second position adjacent the product P, see FIG. 1B. More specifically, as the first flap A1 moves along the slot S, the first and second folding surfaces 42 and 52 gradually lift and move the first flap A1 from its first position to its second position, while at least the first folding surface 42 initially supports at least 30% of the first width $W_{A1}$ of the first flap A1 and by at least an intermediate point $P_{42}$ along the first folding surface 42 fully supports between 90% and 100% and preferably 100% of the first width $W_{A1}$ of the first flap A1. Because both the first and second folding surfaces 42 and 52 transition to be in or near a vertical plane as the first flap A1 exits the slot S, the first flap A1 is easily released from the slot S and positioned against the product P, thereby avoiding film stretching from engagement with structure of the first and second folding members 40 and 50 that might hinder release of the first flap A1. Further, due to the smooth release of the first flap A1 from the first and second folding members 40 and 50 at the end of the slot S, overall production speed can be increased. Just before the fourth flap A4 reaches the folding apparatus 20, the conventional rotating brush (not shown) contacts the film wrapper 10 and folds the fourth flap A4 so it is positioned against the product P.

Representative embodiments of the present disclosure described above can be described as follows:

A. A folding apparatus adapted to be positioned adjacent a conveyor along which product having a flexible film wrapper wrapped about the product moves in a machine direction adjacent the folding apparatus such that the folding apparatus effects the folding of a first flap of the wrapper, the first flap having a first width extending from the product to an outermost edge of the first flap, the first width extending transverse to the machine direction, the folding apparatus comprising:

a passive folding device comprising a first passive folding member defining a first passive folding surface adapted to engage the first flap as the product and the film wrapper move in the machine direction and folding the first flap from a first position away from the product to a second position adjacent the product, the first passive folding surface comprising an entry section and an exit section and having a second width that increases from the entry section to an intermediate point between the entry section and the exit section to a size sufficient to support a substantial portion of the first flap as the flap moves from the intermediate point toward the second position.

B. The folding apparatus of paragraph A, wherein the first passive folding surface comprises an entry section positioned in a first plane and an exit section positioned in a second plane generally transverse to the first plane.

C. The folding apparatus of paragraph B, wherein the first plane comprises a generally horizontal first plane and the second plane comprises a generally vertical second plane.

D. The folding apparatus of paragraphs B or C, wherein an angle of the first passive folding surface relative to a horizontal plane varies from the entry section to the exit section.

E. The folding apparatus of paragraph D, wherein the angle of the first passive folding surface relative to a horizontal plane changes from the entry section to an intermediate point along the first passive folding surface at a rate that is greater than the rate at which the angle of the first passive folding surface changes from the intermediate point to the exit section.

F. The folding apparatus of any one of paragraphs A-E, wherein the second width of the first passive folding surface increases in size as the first passive folding surface extends from the entry section to a location near the exit section.

G. The folding apparatus of any one of paragraphs A-F, wherein the folding surface is defined by first and second spaced apart edges, at least one of the first and second edges is shaped substantially as an exponential curve.

H. The folding apparatus of paragraph G, wherein the first edge is substantially linear and the second edge is defined by the one edge of the first passive folding surface shaped substantially as an exponential curve.

I. The folding apparatus of any one of paragraphs A-H, wherein the passive folding device further comprises a second passive folding member defining a second passive folding surface, the first and second passive folding members being positioned relative to one another such that the first and second passive folding surfaces are spaced apart and opposed to one another to define a slot into and through which the first flap moves as it is folded from the first position away from the product to the second position adjacent the product.

J. The folding apparatus of paragraph I, wherein the first and second passive folding members are formed from a substantially transparent polymeric material.

K. The folding apparatus of any one of paragraphs A-J, wherein the passive folding device further comprises a passive folding element for engaging and folding a second flap from a first position away from the product to a second position adjacent the product.

L. A folding apparatus adapted to be positioned adjacent a conveyor along which product having a flexible film wrapper wrapped about the product moves in a machine direction adjacent the folding apparatus such that the folding apparatus effects the folding of a first flap of the wrapper, the first flap having a first width extending from the product to an outermost edge of the first flap, the first width extending transverse to the machine direction, the folding apparatus comprising:

a passive folding device comprising a first passive folding member defining a first passive folding surface adapted to engage the first flap as the product and the film wrapper move in the machine direction and folding the first flap of the film wrapper from a first position away from the product to a second position adjacent the product, the first passive folding surface comprises an entry section which is positioned in a first plane and an exit section which is positioned in a second plane generally transverse to the first plane.

M. The folding apparatus as set forth in paragraph L, wherein the first passive folding surface transitions through 90 degrees from the entry section to the exit section.

N. The folding apparatus of paragraphs L or M, wherein the first plane comprises a generally horizontal first plane and the second plane comprises a generally vertical second plane.

O. The folding apparatus of any one of paragraphs L-N, wherein the angle of the first passive folding surface relative to a horizontal plane changes from the entry section to an intermediate point along the first passive folding surface at a rate that is greater than the rate at which the angle of the first passive folding surface changes from the intermediate point to the exit section.

P. The folding apparatus of any one of paragraphs L-O, wherein the second width of the first passive folding surface increases in size as the first passive folding surface extends from the entry section to a location near the exit section.

Q. The folding apparatus of any one of paragraphs L-P, wherein the first passive folding surface is defined by first and second spaced apart edges, at least one of the first and second edges is shaped as an exponential curve.

R. The folding apparatus of paragraph Q, wherein the first edge is substantially linear and the second edge is defined by the one edge of the first passive folding surface shaped as an exponential curve.

S. The folding apparatus of any one of paragraphs L-R, wherein the passive folding device further comprises a second passive folding member defining a second passive folding surface, the first and second passive folding members being positioned relative to one another such that the first and second passive folding surfaces are spaced apart and opposed to one another to define a slot into and through which the first flap moves.

T. The folding apparatus of any one of paragraphs L-S, wherein the passive folding device further comprises a passive folding element for engaging and folding a second flap from a first position away from the product to a second position adjacent the product.

U. A folding apparatus adapted to be positioned adjacent a conveyor along which product having a flexible film wrapper wrapped about the product moves in a machine direction adjacent the folding apparatus such that the folding apparatus effects the folding of first and second flaps of the wrapper, the folding apparatus comprising:

a passive folding device comprising:

a first passive folding member defining a first passive folding surface, a second passive folding member defining a second passive folding surface, the first and second passive folding members being positioned relative to one another such that the first and second passive folding surfaces are spaced apart and opposed to one another to define a slot into and through which the first flap moves as the product and film wrapper move in the machine direction to effect the folding of the first flap of the film wrapper from a first position away from the product to a second position adjacent the product, and a passive folding element coupled to one of the first passive folding member or the second passive folding member for engaging and folding the second flap of the wrapper from a first position away from the product to a second position adjacent the product.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A folding apparatus adapted to be positioned adjacent a conveyor along which product having a flexible film wrapper wrapped about the product moves in a machine direction adjacent the folding apparatus such that the folding apparatus effects the folding of a first flap of the wrapper, the first flap having a first width extending from the product to an outermost edge of the first flap, the first width extending transverse to the machine direction, the folding apparatus comprising:

a passive folding device comprising:

a first passive folding member defining a first passive folding surface adapted to engage the first flap as the product and the film wrapper move in the machine direction and folding the first flap from a first position away from the product to a second position adjacent the product, the first passive folding surface comprising an entry section and an exit section and having a second width that increases from the entry section to an intermediate point between the entry section and the exit section to a size sufficient to fully support a substantial portion of the first flap as the flap moves from the intermediate point toward the exit section; and a passive folding element for engaging and folding a second flap from a first position away from the product to a second position adjacent the product, wherein the passive folding element is fixedly coupled to the first passive folding member.

2. The folding apparatus of claim 1, wherein the entry section of the first passive folding surface is positioned in a first plane and the exit section of the first passive folding section is positioned in a second plane generally transverse to the first plane.

3. The folding apparatus of claim 2, wherein the first plane comprises a generally horizontal first plane and the second plane comprises a generally vertical second plane.

4. The folding apparatus of claim 2, wherein an angle of the first passive folding surface relative to a horizontal plane varies from the entry section to the exit section.

5. The folding apparatus of claim 4, wherein the angle of the first passive folding surface relative to a horizontal plane changes from the entry section to an intermediate point along the first passive folding surface at a rate that is greater than the rate at which the angle of the first passive folding surface changes from the intermediate point to the exit section.

6. The folding apparatus of claim 1, wherein the second width of the first passive folding surface increases in size as the first passive folding surface extends from the entry section to a location near the exit section.

7. The folding apparatus of claim 1, wherein the first passive folding surface is defined by first and second spaced apart edges, at least one of the first and second edges is shaped substantially as an exponential curve.

8. The folding apparatus of claim 7, wherein the first edge is substantially linear and the second edge is defined by the one edge of the first passive folding surface shaped substantially as an exponential curve.

9. The folding apparatus of claim 1, wherein the passive folding device further comprises a second passive folding member defining a second passive folding surface, the first and second passive folding members being positioned relative to one another such that the first and second passive folding surfaces are spaced apart and opposed to one another to define a slot into and through which the first flap moves as the first flap is folded from the first position away from the product to the second position adjacent the product.

10. The folding apparatus of claim 9, wherein the first and second passive folding members are formed from a substantially transparent polymeric material.

11. A folding apparatus adapted to be positioned adjacent a conveyor along which product having a flexible film wrapper wrapped about the product moves in a machine direction adjacent the folding apparatus such that the folding apparatus effects the folding of a first flap of the wrapper, the first flap having a first width extending from the product to an outermost edge of the first flap, the first width extending transverse to the machine direction, the folding apparatus comprising:

a passive folding device comprising:

a first passive folding member defining a first passive folding surface adapted to support the first flap as the product and the film wrapper move in the machine direction and folding the first flap of the film wrapper from a first position away from the product to a second position adjacent the product, the first passive folding surface comprises an entry section which is positioned in a first plane and an exit section which is positioned in a second plane generally transverse to the first plane; and a passive folding element for engaging and folding a second flap from a first position away from the product to a second position adjacent the product, wherein the passive folding element is fixedly coupled to the first passive folding member.

12. The folding apparatus as set forth in claim 11, wherein the first passive folding surface transitions through 90 degrees from the entry section to the exit section.

13. The folding apparatus of claim 11, wherein the first plane comprises a generally horizontal first plane and the second plane comprises a generally vertical second plane.

14. The folding apparatus of claim 11, wherein the angle of the first passive folding surface relative to a horizontal plane changes from the entry section to an intermediate point along the first passive folding surface at a rate that is greater than the rate at which the angle of the first passive folding surface changes from the intermediate point to the exit section.

15. The folding apparatus of claim 11, wherein the second width of the first passive folding surface increases in size as the first passive folding surface extends from the entry section to a location near the exit section.

16. The folding apparatus of claim 11, wherein the first passive folding surface is defined by first and second spaced apart edges, at least one of the first and second edges is shaped as an exponential curve.

17. The folding apparatus of claim 16, wherein the first edge is substantially linear and the second edge is defined by the one edge of the first passive folding surface shaped as an exponential curve.

18. The folding apparatus of claim 11, wherein the passive folding device further comprises a second passive folding member defining a second passive folding surface, the first and second passive folding members being positioned relative to one another such that the first and second passive folding surfaces are spaced apart and opposed to one another to define a slot into and through which the first flap moves.

19. A folding apparatus adapted to be positioned adjacent a conveyor along which product having a flexible film wrapper wrapped about the product moves in a machine direction adjacent the folding apparatus such that the folding apparatus effects the folding of first and second flaps of the wrapper, the folding apparatus comprising:

a passive folding device comprising:

a first passive folding member defining a first passive folding surface, a second passive folding member defining a second passive folding surface, the first and second passive folding members being positioned relative to one another such that the first and second passive folding surfaces are spaced apart and opposed to one another to define a slot into and through which the first flap moves as the product and film wrapper move in the machine direction to effect the folding of the first flap of the film wrapper from a first position away from the product to a second position adjacent the product, and a passive folding element fixedly coupled to one of the first passive folding member or the second passive folding member for engaging and folding the second flap of the wrapper from a first position away from the product to a second position adjacent the product.

* * * * *